United States Patent [19]

Holmes

[11] Patent Number: 4,519,630

[45] Date of Patent: May 28, 1985

[54] BOOK COVER

[75] Inventor: Gordon W. Holmes, Mississauga, Canada

[73] Assignee: Professional Packaging Limited, Mississauga, Canada

[21] Appl. No.: 368,890

[22] Filed: Apr. 16, 1982

[51] Int. Cl.[3] ..... B42D 3/00; B42D 3/04

[52] U.S. Cl. ..... 281/31; 281/19 R; 281/34; 281/35; 281/36; 281/37

[58] Field of Search ..... 281/31, 34, 35, 28, 281/29, 30, 19 R, 36, 37, 46

[56] References Cited

U.S. PATENT DOCUMENTS

| | | | |
|---|---|---|---|
| 473,502 | 4/1892 | Harison | 281/34 |
| 639,451 | 12/1899 | Smalley | 281/34 |
| 912,775 | 2/1909 | Ayvad | 281/34 |
| 1,919,827 | 7/1933 | Cooper | 281/36 |
| 2,145,098 | 1/1939 | Sharp | 281/34 |
| 3,169,029 | 2/1965 | Margolis | 281/29 |
| 3,201,145 | 8/1965 | Libby | 281/37.5 |
| 3,231,296 | 1/1966 | Margolis | 281/29 |
| 3,572,767 | 3/1971 | Learned et al. | 281/29 X |
| 3,708,184 | 1/1973 | Slanhoff | 281/34 X |
| 3,964,770 | 6/1976 | Abildgaard et al. | 281/29 |
| 4,209,187 | 6/1980 | Forrest | 281/34 X |

*Primary Examiner*—Paul A. Bell
*Assistant Examiner*—Taylor J. Ross
*Attorney, Agent, or Firm*—Sim & McBurney

[57] ABSTRACT

A novel inexpensive but durable book cover is provided which enables hard cover books to be provided at a substantially decreased cost with respect to conventional hard cover books. The binder comprises cover members comprising overlying panels which are joined to provide pockets in which may be received the cover of a paperback book and a spine hinged to the cover members through fold lines. The interiors of the pockets are embossed to aid in the insertion of the paperback book covers.

6 Claims, 7 Drawing Figures

BOOK COVER

FIELD OF INVENTION

A hard cover version of a book commands a much higher price than a paperback version of the same book. This disparity in price reflects the difference in manufacturing costs between the two methods of binding. Although convenient and of lower cost, paperback books lack durability and have an inferior physical appearance in comparison with hard cover books. As noted above, however, hard cover books are significantly more expensive.

SUMMARY OF INVENTION

In accordance with the present invention, there is provided a novel book cover or binder which enables paperback books to be positioned in a hard external cover, either pemanently or on a temporary basis.

The book cover of the invention comprises a spine member and two cover members integrally joined to the spine member by a fold line at the longitudinal edges thereof. Each cover member is formed of overlying layers of paperboard which are joined to define a pocket therebetween which is open to receive a book cover at the edge adjacent the join of the respective cover member to the spine member and which is enclosed at the other three edges by folded over paperboard.

In this way, the present invention enables a hard cover book to be provided at a reduced cost when compared with conventional hard cover books.

In one embodiment, the cover member is formed by folding on each other two panels which are integrally joined through a fold line to provide the folded-over edge at the fold line and by joining the two panels together by wing panels, which are integrally joined to the one panel which is joined to the spine member and folded upon that panel, through adhesion between the abutting faces of the wing panels and the other panel, thereby to provide the folded over edge at the other two edges.

Preferably, spacer means are located within each of the pockets to space the overlying layers from each other, to assist in the insertion of a paperback book cover into the respective pocket and to permit sliding motion between the paperback book cover and the pocket upon opening and closing of the book binder. The spacer means may take the form of discontinuous embossings which are formed on the face of the wing panel abutting the one panel.

DESCRIPTION OF PREFERRED EMBODIMENTS

Figure 1:
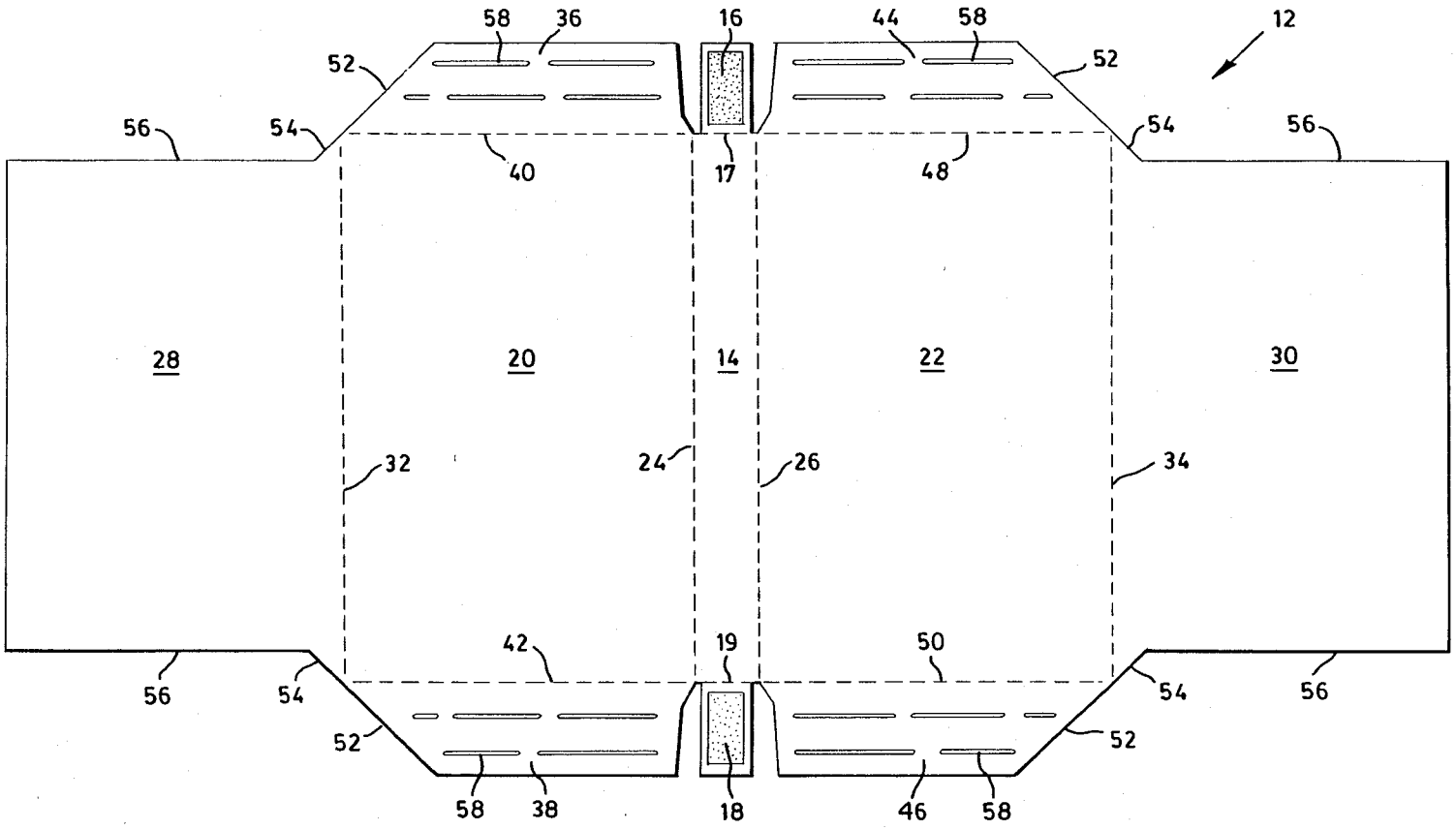
FIG. 1 is a plan view of a blank from which a book cover according to the invention can be formed.

Referring first to FIGS. 1 to 4, a novel book cover 10 provided in accordance with a preferred embodiment of the invention is formed from a blank 12. The blank 12 includes an elongate central strip 14, which forms the spine for the cover 10, having tabs 16 and 18 extending from the ends thereof and joined thereto through fold lines 17 and 19 respectively. The central strip 14 is joined to inner panels 20 and 22 through fold lines 24 and 26 respectively, while the inner panels 20 and 22 are joined to outer panels 28 and 30 through fold lines 32 and 34 respectively.

The inner panel 20 has wing panels 36 and 38 joined thereto by fold lines 40 and 42 respectively. The inner panel 22 has similar wing panels 44 and 46 joined thereto by fold lines 48 and 50. The fold lines 40, 17 and 48 are in straight line alignment as are fold lines 42, 19 and 50.

The wing panels 36 and 44 and the wing panels 38 and 46 each has a longitudinal edge 52 which extends at approximately 45° to the respective fold line 40, 48, 42 and 50 from the free longitudinal side edge to the point of intersection of the fold lines 32 and 40, 34 and 48, 32 and 42, and 34 and 50 respectively. The edges 52 are in alignment with cuts 54 formed in the outer panels 28 and 30 and extending from the points of join of fold lines 32 and 40, 32 and 42, 34 and 48, and 34 and 50, so that the lateral edges 56 of the end panels are aligned in pairs but the aligned pairs are spaced inwardly with respect to the aligned fold lines 40, 17 and 48 and 42, 19 and 50.

The wing panels 36, 38, 44 and 46 are each provided with lines of embossing 58 on the surface thereof. The purpose of these embossings 58 will become apparent from the discussion below.

To form the binder 10 from the blank 12, the tabs 16 and 18 are folded about fold lines 17 and 19 and adhered to the central strip 14.

The wing panels 36, 38, 44 and 46 are folded about fold lines 40, 42, 48 and 50 respectively into abutting relation with respective panels 20 and 22. Outer panels 28 and 30 are folded about fold lines 32 and 34 to overly and abut the folded over wing panels 36, 38, 44 and 46, and the abutting portions adhesively joined together.

Figure 2:
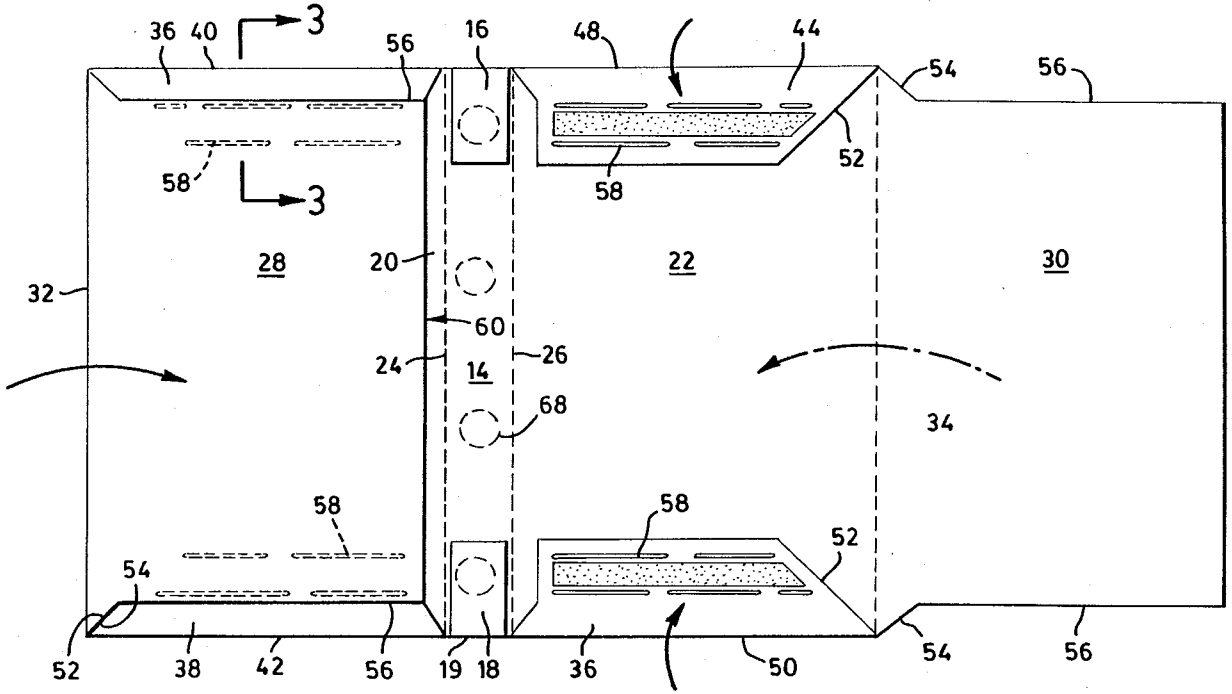
FIG. 2 illustrates the steps required to assemble a book cover according to the invention from the blank of FIG. 1.
Figure 3:
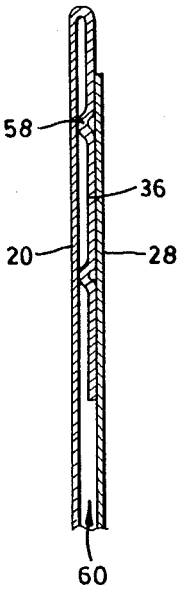
FIG. 3 is a sectional view on line 3—3 of FIG. 2.
Figure 4:
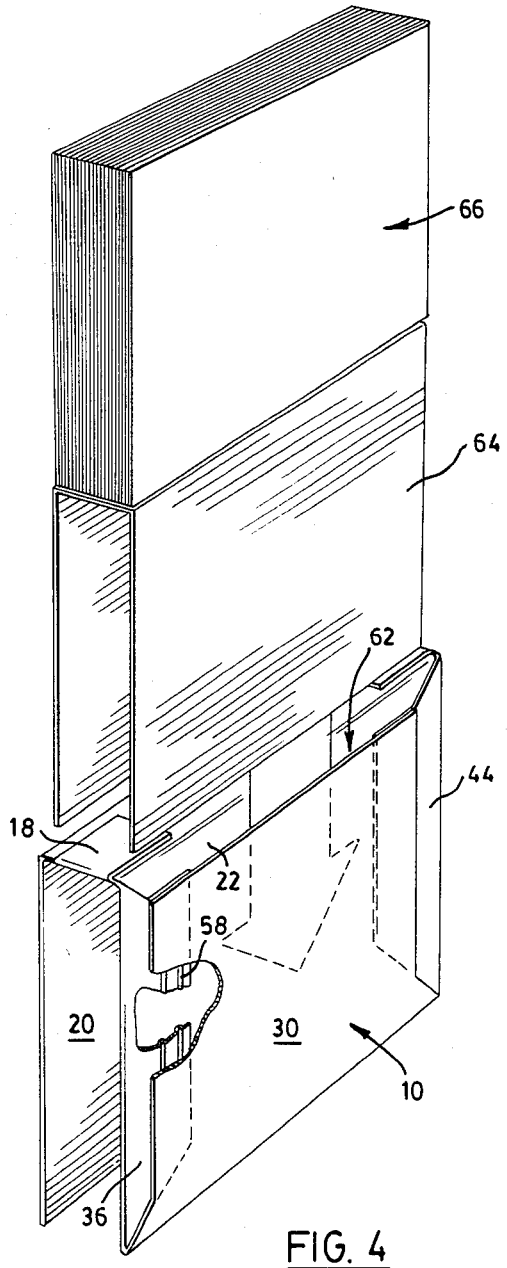
FIG. 4 shows assembly of a paper backed book with the book cover of the invention.

As may be seen from FIG. 2, the edges 52 and 54 form mitered corners and the foldings of the panels about the respective fold lines ensure that there are rounded edges on all sides. The folded over outer panels 28 and 30 combine with the inner panels 20 and 22 respectively to define pockets 60 and 62 which are able to receive the covers 64 of a paperback book 66 therein.

Figure 5:
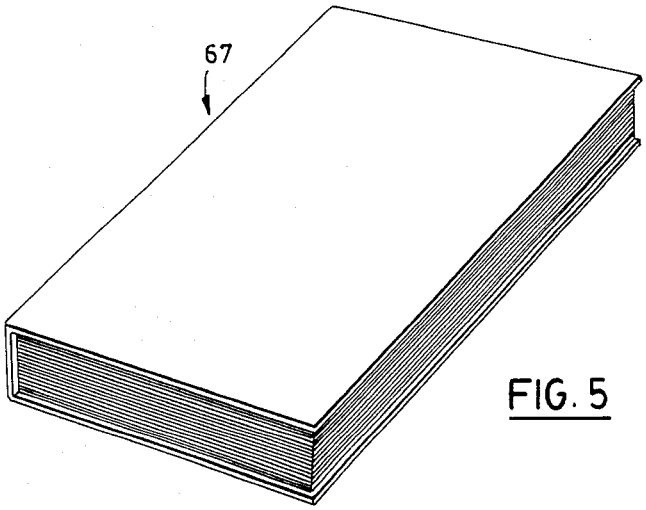
FIG. 5 is a perspective view of the cover assembled with a paper backed book in the closed position.
Figure 6:
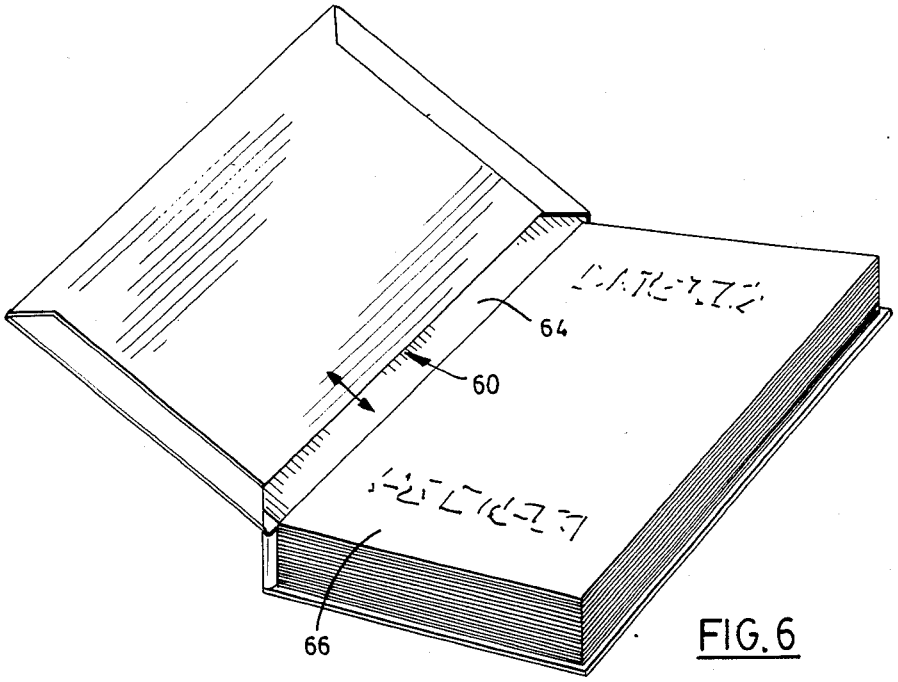
FIG. 6 is a perspective view of the cover assembled with a paper backed book in the open position.

The embossings or ridges 58 serve to maintain the overlying panels 28, 20 and 30, 22 respectively spaced from each other to enable the cover of the book 66 to be readily inserted into the pockets 60 and 62 to provide a finished hard cover book 67. In addition, the embossings permit the paperbook covers to slide freely in the pockets 60 and 62 as the hard book is opened and closed, as is illustrated in FIGS. 5 and 6. As the cover 10 is opened, the cover 64 of the paperback book 66 slides freely out of the pocket 60 and, when again closed, the cover 64 slides back into the pocket 60.

This sliding motion of the paperback cover 64 in the pocket 60 has several advantages. The pulling action and wear and tear on the original glued binding of the paperback is decreased, improving its appearance and extending the life cycle. Any binding action which otherwise may occur between the paperback cover 64 and the pocket 60 would cause creasing and crushing of the cover 64 and prevent proper closing of the cover 10.

The sliding action of the cover 64 in the pockets 60 and 62, resulting from the use of the embossings 58 also eliminates added stress or binding action on the creases 24 and 26 at the spine of the cover 10 and thereby adds to the maintenance of the external appearance of the cover 10 and the long term durability of the cover 10.

The embossed lines 58 are discontinuous, so as to avoid accidental folding of the wing panels about the embossings and to provide only a minimal frictional resistance to entry of the book cover into the pockets 60 and 62 and to sliding action upon opening and closing the cover 10.

When a paperback book 66 is received by the cover 10, it overlies the line of overlap of the panels 28 and 30, with the wing panels 36, 38 and 44, 46 respectively, and only the mitered corners of the abutting edges 52 and 54 appear. The result is an overall seamless appearance. There are no raw edges which appear anywhere and those that do exist are hidden by the pages of the book. This feature enhances the overall appearance of the cover and its resemblance to a conventional hard cover book.

The cover 10 may be of a permanent or non-permanent nature, as desired. In the first instance, the central strip 14 or spine of the cover is provided with spot gluings 68 which serve to adhesively join the cover spine to the book spine. A lower priced paperback book with an unprinted cover, in this way, may be inserted and glue-bonded into the cover, thereby forming a hard cover book. In the second instance, the book is inserted into a cover without the presence of the adhesive, and the cover then may be reused, as desired, by removal of one paperback book and insertion of another. This alternative permits the book cover 10 to be sold as is for use by customers with paperback books in their possession.

The book cover 10 which is provided by this invention, represents a low-cost viable alternative hard cover for books to traditional hard book covers. The book cover 10 can be manufactured rapidly and automatically on high speed equipment, requiring only die-cutting of the blank 12 and folding and adhesion of panels. The cover 10 is formed at low cost from a single blank element 12 to produce a book cover 10 at a fraction of the price of a traditional hard cover book yet with the same quality and prestige appearance.

The book cover 10 is an attractive alternative and has a close external resemblance to the traditional hard cover for books and possesses no visible raw edges or glue seams which would detract from its aesthetic appearance.

The book cover 10 is capable of being printed, lithographed, silk screened or hot-stamped, as desired, to provide full colour graphics, or any other desired graphics designs, to the exterior. The book cover 10 is strong and durable and can be freely opened and closed, as a result of sliding of the paperback cover in the pockets, without loss of effectiveness in use.

In some instances of use of the book cover 10, for example with larger heavier books, reinforcing tape may be applied in the hinge areas. In addition, further thickening or reinforcing to the cover 10 may be provided by inserting a sheet of rigid material, such as, sheets of chip board or corrugated paperboard, into each of the pockets 60 and 62.

For decorative and strengthening purposes, the outer surfaces of the book cover 10 may be laminated with light fabrics, plastic films and decorative papers. A wide variety of textures and surface finishes may be obtained in this way. In addition, the book cover 10 may be lithographed in full colour and then cellucoated or lacquered to provide a durable washable surface on the book cover, which enhances both the appearance and the life cycle of the cover.

A further feature of the book cover 10 is that both the inside and outside surfaces of the cover may be printed at substantially no additional cost, by printing the blank 12 in contrast to traditional book covers, which require a separate printing and labelling operation.

Depending on the size of the book to be held in the cover and other factors, the caliper and quality of folding paperboard which can be employed to form the cover may vary widely. Usually, the caliper of folding paperboard varies between about 0.012 and about 0.032 inches.

The book binder 10 of this invention is adaptable for other purposes, such as, general binders, presentation kits and loose-leaf covers.

Figure 7:
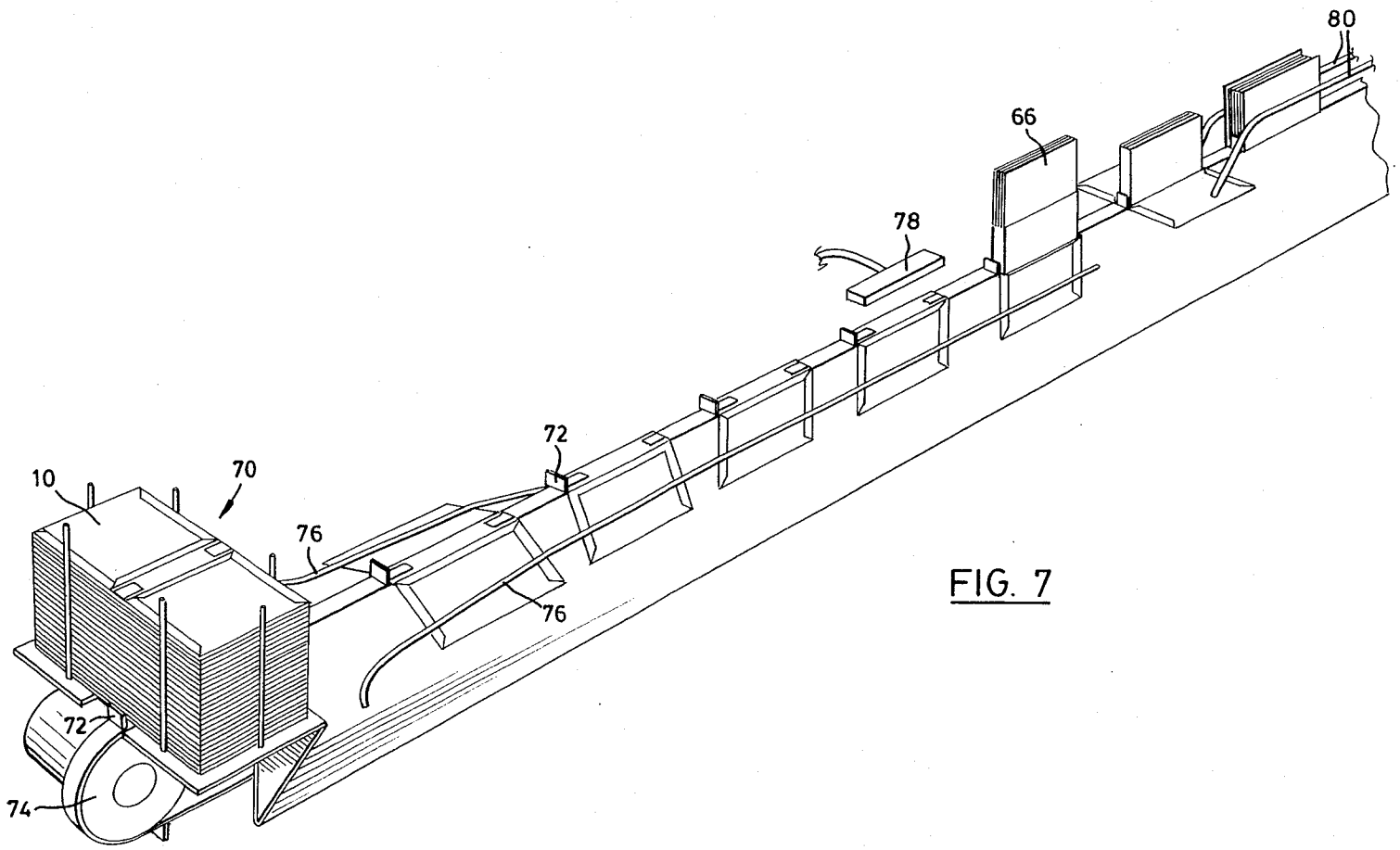
FIG. 7 is a perspective view of an automated operation for assembly of a book with the cover of the invention.

As mentioned above, the book binder 10 is susceptible of automatic assembly with paperback books. One procedure is illustrated in FIG. 7. As illustrated therein, individual binders 10 are propelled one at a time from the base of a stack 70 of planar binders by pushers 72 driven by a chain drive 74. The binders 10 in the stock 70 are arranged with the intended interior of the binders facing upwards. The individual binders 10, as they are conveyed, are engaged by curved folding rods 76 which gradually bend the cover members down about the conveyor chain 74 to assume a position suitable for receipt of a paperback book 66 therein wherein the covers depend vertically downwardly from the horizontally-extending spine.

Hot melt adhesive, or any other convenient adhesive, is automatically applied to the spine of the cover by a suitable applicator 78. Immediately thereafter, the covers 64 of the book 66 are inserted into the pockets 60 and 62 of the book cover 10 until the spine of the book engages and is thereby adhesively joined to the spine of the binder 10.

Thereafter, lifters lift the covers of the binder into engagement with the book which is then conveyed between rails 80 to packing. By this procedure a hard cover book has been produced at a significantly decreased cost, as compared with conventional hard cover books.

SUMMARY OF DISCLOSURE

In summary of this disclosure, the present invention provides a novel hard cover book binder which is significantly distinctive from prior art hard cover books. Modifications are possible within the scope of this invention.

What I claim is:

1. A book binder, comprising:

an elongate spine member having two longitudinal side edges and two cover members integrally joined to said spine member, said integral join between said spine member and one of said cover members being effected by a first fold line formed at one of said longitudinal side edges of said spine member and said integral join between said spine member and the other of said cover members being effected by a second fold line formed at the other of said longitudinal side edges of said spine member, each said cover member being formed of overlying layers of paperboard which are joined so as to define a pocket therebetween which is open to receive a book cover at an edge of the pocket adjacent the fold line join of the respective cover member to the spine member and which is enclosed at the other three edges by folded-over paperboard, each said cover member having discontinuous embossings formed within said pocket to space said overlying layers from each other, thereby to assist in insertion of a book cover into the respective pocket and to permit ready sliding of the book cover in the respective pocket.

2. The book binder of claim 1 further comprising adhesive means on said elongate spine member in combination with a book having a spine, said book being permanently located in said binder by adhesion between abutting faces of said elongate spine member and the spine of the book.

3. The book binder of claim 1 wherein each said cover member is formed by:

providing two panels integrally joined through a third fold line, said two layers being said overlying layers in said cover members, the one of said panels which constitutes the one of said overlying layers joined to said spine member having wing panels integrally joined thereto at opposite free edges thereof, folding said wing panels to overly and abut said one panel, folding said two panels on each other about said third fold line to provide a folded-over panel overlying the folded-over wing panels and an underlying panel, and adhering abutting faces of the wing panels and the folded-over panel.

4. The book binder of claim 3 wherein said wing panels are provided with said discontinuous embossings.

5. The book binder of claim 3 or 4 wherein said other panel and said wing panels are shaped to provide mitered corners between edge abutting surfaces thereof at the corners of the cover members.

6. A blank for a book binder, comprising:

a central elongate panel having tabs integrally joined to the lateral ends thereof through first and second crease lines, first and second rectangular panels joined at one longitudinal side edge thereof one to each longitudinal side edge of said central elongate panel through third and fourth crease lines, third generally rectangular panel joined at one longitudinal side edge thereof to the first rectangular panel at the other longitudinal side edge thereof through fifth crease line, fourth generally rectangular panel joined at one longitudinal side edge thereof to the second rectangular panel at the other longitudinal side edge thereof through sixth crease line, first and second wing panels joined one to each of the lateral side edges of the first rectangular panel through seventh and eighth crease lines, and third and fourth wing panels joined one to each of the lateral side edges of the second rectangular panel through ninth and tenth crease lines, said first, seventh and ninth crease lines being in straight line alignment and said second, eighth and tenth crease lines being in straight line alignment, each said wing panel having embossings extending laterally thereof, each said wing panel having a side edge extending angularly at an approximate angle of 45° from the free lateral edge thereof to the point of join of the crease line joining the wing panel to the respective rectangular panel and the crease line joining the respective rectangular panel and generally rectangular panel, each said generally rectangular panel including an angularly directed edge in straight line alignment with said angular side edge of said wing panel extending from said point of join to the respective lateral side edge of said generally rectangular panel.

* * * * *